US005553524A

United States Patent [19]

Fujita

[11] Patent Number: 5,553,524

[45] Date of Patent: Sep. 10, 1996

[54] STRIPPER DEVICE AND PUNCH ASSEMBLY USING SAME

[75] Inventor: Oriya Fujita, Hadano, Japan

[73] Assignee: Amada Metrecs Company, Limited, Kanagawa, Japan

[21] Appl. No.: 312,806

[22] Filed: Sep. 27, 1994

[30] Foreign Application Priority Data

Oct. 1, 1993 [JP] Japan ..... 5-246875
Jul. 18, 1994 [JP] Japan ..... 6-165356

[51] Int. Cl.[6] ..... B21D 45/08; B26F 01/02

[52] U.S. Cl. ..... 83/137; 83/138

[58] Field of Search ..... 83/137, 527, 140, 83/141, 142, 143, 136, 138

[56] References Cited

U.S. PATENT DOCUMENTS

| | | | |
|---|---|---|---|
| 2,716,451 | 8/1955 | Taylor | 83/137 |
| 3,147,657 | 9/1964 | Williamson | 83/140 |
| 4,092,888 | 6/1978 | Wilson | 83/140 |
| 4,292,869 | 10/1981 | Wallis . | |
| 4,332,179 | 6/1982 | Wallis | 83/137 |
| 4,516,448 | 5/1985 | Hill | 83/143 |
| 5,054,347 | 10/1991 | Johnson | 83/527 |

FOREIGN PATENT DOCUMENTS

| | | | |
|---|---|---|---|
| 0532147 | 3/1993 | European Pat. Off. . | |
| 0622135 | 11/1994 | European Pat. Off. . | |
| 0009725 | 8/1956 | Germany | 83/527 |

OTHER PUBLICATIONS

European Search Report dated Nov. 10, 1994.

*Primary Examiner*—Kenneth E. Peterson
*Assistant Examiner*—Sean A. Pryor
*Attorney, Agent, or Firm*—Wigman, Cohen, Leitner & Myers, P.C.

[57] ABSTRACT

A stripper device for a punching tool comprises: a gas cylinder (5) filled with a gas (7) having a cylinder head (27) and a cylinder end (17) attached to a lower end of the cylinder head airtightly; and a piston (9) having a punch head (11) and a piston rod (15); an axial movement restricting member (13, 201) for restricting an axial movement of the piston in the gas cylinder filled with the gas; and a rotational movement restricting members (31; 205, 203) for restricting a rotational movement of the piston in the cylinder body. A stripping force of the stripper device can be obtained by a resilient force generated whenever the gas is compressed by the piston within the gas cylinder for each punching operation. The punch assembly enables plate material of various thicknesses to be punched out without generating stripping miss. Further, when the stripper device is assembled with a punch body (19) as a punch assembly, the assembly length of the punch assembly can be adjusted finely by a stroke adjusting mechanism composed of a locating pin (41), locating holes (43) and thread engagement of the piston with the punch body.

11 Claims, 9 Drawing Sheets

STRIPPER DEVICE AND PUNCH ASSEMBLY USING SAME

BACKGROUND OF THE INVENTION

1. Field of the Invention

The present invention relates to a stripper device for a punching tool and a punch assembly using the same stripper device.

2. Description of the Prior Art

FIG. 1 shows a conventional punch assembly used for a punch press. This punch assembly 101 is mainly composed of three parts of a punch body 103, a punch guide 105, and a compression spring 107. The punch body 103 is formed with a punch trunk portion 109, a small-diameter punch head mounting portion 111 formed on an upper side of the punch trunk portion 109, and a cutting edge portion 113 formed on a lower side of the punch trunk portion 109. The punch guide 105 is formed into a hollow cylindrical shape, and further formed with a flange portion 115 and a punch guide hole 117 for guiding the punch trunk portion 109 of the punch body 103 in the axial direction thereof. Further, the punch guide 105 is formed with a key groove 119 on an inner side wall of the punch guide hole 117 so as to extend from the flange portion 115 to near the lower end of the punch guide 105.

A key 121 is attached to the punch body 103 so as to be engaged with the key groove 119 formed in the punch guide 105. Therefore, the punch trunk portion 109 fitted to the punch guide hole 117 of the punch guide 105 is slidably movable only in the axial direction thereof, without rotation under the restriction of the engagement of the key 121 attached to the punch body 103 with the key groove 119 formed in the punch guide 105.

The punch head mounting portion 111 of the punch body 103 projects from the upper end of the punch guide 105. The punch mounting portion 111 of the punch body 103 is formed with a male thread portion 123 at the upper end thereof. A punch head 125 is screwed with this male thread portion 123 of the punch body 103 so that the height of the punch head 125 can be adjusted. Further, the punch head 125 is formed with a flange portion 131 and a lower and outer conical portion 127. A plurality (two or three) of screw holes 133 are formed in the flange portion 131 of the punch head 125 at regular intervals of angle. Further, a flat annular fastening member 129 is fitted to a lower conical portion 127 formed in the punch head 125.

Further, a retainer collar 137 is fitted to a tapered portion 135 formed between the large-diameter punch trunk portion 109 and the small-diameter punch head mounting portion 111 of the punch body 103. The retainer collar 137 is formed with a flange portion 139 at the middle thereof, whose outer diameter is roughly equal to that of the flat annular fastening member 129. The flange portion 139 is in contact with the flange portion 115 of the punch guide 105. An O-ring (sealing member) 141 is interposed between the outer circumference of the cylindrical portion projecting downward from the flange portion 139 of the retainer collar 137 and the inner circumference of the punch guide hole 117 of the punch guide 105 so that the retainer collar 137 can be removably inserted into the punch guide hole 117 of the punch guide 105.

The compression spring 107 is interposed between the flat annular fastening member 129 fitted to the punch head 125 and the flange portion 139 of the retainer collar 137 under a predetermined spring force so as to function as a stripper of the punch body 103. Further, this stripper compression spring 107 can be replaced with another spring such as urethane spring or dish spring, etc.

Further, the punch guide 105 is formed with an outer key groove 143 engaged with a key (not shown) formed in a die holder of a punch press, to decide the angular position of the punch press relative to the die.

The above-mentioned punch assembly (male type) 101 is used together with a mated die (female type) as a pair of punching tool. Therefore, when the punch head 125 is struck by a striker (not shown) of the punch press, plate material can be punched off by the punching tool.

In the above-mentioned conventional punch assembly 101 constructed as described above, when a large stripping Force (or load) is required for the punching, a compression spring 107 with a large spring constant must be used. For instance, when a punching force of 30 ton is required for a plate material with a thickness of 6 mm, the required stripping force for stripping the punch from the punched plate material is as large as 3, 000 kg. In this case, since the required total deformation (compression stroke) of the compression spring 107 is about 10 mm, the spring constant of the compression spring 107 becomes as large as 300 kg/mm.

Accordingly, in order to mount the compression spring 107 as strong as above between the punch head 125 and the retainer collar 137 so as to have a predetermined mounting load (an initial tripping force), a large force is required to deform the compression spring 107 of a large spring constant.

In addition, whenever the cutting edge portion 113 of the punch body 103 is polished, the compression spring 107 must be removed from between the punch head 125 and the retainer collar 137. In this case, however, since the female thread portion of the punch head 125 is strongly engaged with the male thread portion 123 of the punch head mounting portion 111 of the punch body 103 on the basis of a wedge effect of the annular fastening member 129 against the conical portion 127 of the punch head 125, the removal step of the compression spring 107 from the punch assembly 101 is such that: first, two screws are turned into the screw holes 133 formed in the punch head 125 and then the two screws are turned to loosen the annular fastening member 129 away from the compression spring 107, thus causing a problem in that a troublesome work and a strong work force are required for the removal of the punch head 125 from the punch body 103.

Further, after the cutting edge portion 113 has been polished, since the length of the punch body 103 is reduced due to the polishing, although the total length of the punch assembly 101 must be adjusted again, the similar troublesome work and strong removal force are required.

Further, the compression spring 107 is usually designed on the basis of the maximum thickness of the plate material to be punched. Therefore, when a plate material with a relatively small thickness is punched, since a stripping force generated by the compression spring 107 is fairly reduced (because the deformation of the compression spring is small), there arises another problem in that stripping miss occurs frequently. Once the stripping miss occurs, the punch body 103 cannot be removed from the punched plate material.

Furthermore, recently, in order to reduce noise generated during punching processing, there has been developed such a punch press that a hydraulic source is used to drive the punch assembly of the punch press. In this case, since the punching speed is reduced, the area of the secondary shearing surface (described later) inevitably increases, so that the material adheres to the cutting edge portion of the punch due to fusion, thus causing another problem in that the stripping miss easily occurs.

In order to reduce the stripping miss generated when thin material is punched, it may be possible to increase the initial compression force of the compression spring 107 used as a stripper device for a punching tool. In this case, however, since the mounting load of the compression spring 107 increases excessively when thick material is to be punched, the punched products must be pushed by use of additional plate material pushing members, thus causing another problem in that punched products are damaged (nicks or gouges) by the plate material push members. At the same time, since a large internal stress is inevitably generated and concentrated in the compression spring 107, the lifetime of the compression spring is relatively short, and thereby the assembly and disassembly work of the punch assembly are more troublesome and difficult.

Further, as another method of overcoming the above-mentioned problems, it may be possible to use a plurality of small compression springs. In this case, however, since a large compression spring mounting space is required, this method cannot solve the afore-mentioned various problems fundamentally.

SUMMARY OF THE INVENTION

With these various problems in mind, therefore, it is the object of the present invention to provide a durable stripper device used for a punching tool, whose spring constant of the compression spring will not change abruptly, even if the thickness of the plate material to be punched changes.

Another object of the present invention is to provide a durable punch assembly, to and from which the stripper device can be mounted and dismounted easily and in addition the assembly length of the punch assembly can be readjusted easily.

The other object of the present invention is to provide a durable punch assembly, which can eliminate the stripping miss for various plate material from a thin plate to a thick plate.

To achieve the above-mentioned objects, the present invention provides a stripper device for a punching tool, comprising: a gas cylinder (5) filled with a gas (7) having: a cylinder head (27); and a cylinder end (17) attached to a lower portion of said cylinder head airtightly; a piston (9) having: a punch head (11); and a piston rod (15); axial movement restricting means (13, 201) for restricting an axial movement of said piston in said gas cylinder filled with the gas; and a rotational movement restricting means (31; 205, 203) for restricting a rotational movement of said piston in said cylinder body, a stripping force of the stripper device being obtained by a resilient force generated whenever the gas is compressed by said piston within said gas cylinder for each punching operation.

In the stripper device, the axial movement restricting means is an engagement flange (13) formed between said piston rod and said punch head and located in an inner space of said gas cylinder. Further, the rotational movement restricting means is a axial rod (31) provided between said cylinder head (27) and said cylinder end (17) and loosely passed through an engage hole (29) formed in said engage flange (13).

Further, in the stripper device, the axial movement restricting means is a snap ring (201) attached to a lower end of said piston rod and located in an outer side of said gas cylinder. Further, the rotational movement restricting means is a key (205) attached to an inner surface of said cylinder end (17) and a key groove (203) formed in an outer surface of said cylinder rod (15) along an axial direction thereof.

Further, the cylinder end (17) further comprises a lower engagement projection (35) engaged with a guide hole (55) of a punch guide (33) attached to the cylinder end (17). Further, the piston (9) further comprises a punch body fixing portion (21) for fixing a punch body (19) to a lower end of said piston.

Further, the present invention provides a punch assembly, comprising: a gas piston (5) filled with a gas (7) having: a cylinder head (27); and a cylinder end (17) attached to a lower portion of said cylinder head airtightly; a piston (9) having: a punch head (11); a piston rod (15); and a punch body fixing portion (21) formed with a thread portion (23); axial movement restricting means (13, 201) for restricting an axial movement of said piston in said gas cylinder filled with the gas; first rotational movement restricting means (31; 205,203) for restricting a rotational movement of said piston in said cylinder body, a stripping force of the stripper device being obtained by a resilient force generated whenever the gas is compressed by said piston within said gas cylinder for each punching operation; a punch guide (33) formed with a hollow guide hole (55) and attached to a lower end of said cylinder end (17); a punch body (19) fitted to the hollow guide hole of said punch guide and formed with a cutting edge (63) at a lower end thereof and another thread portion (61) engaged with the lower mated thread portion (23) formed on said punch body fixing portion (21); a second rotation movement restricting means (59, 57) for restricting a rotational movement of said punch body in said punch guide (33); and means for finely adjusting assembly length of the punch assembly whenever the punch assembly is disassembled for polishing the cutting edge of said punch body.

Further, the second rotational movement restricting means is a key (59) attached to said punch body (19) and engaged with a key groove (57) formed in said punch guide (33). Further, the assembly length adjusting means comprises: at least one locating pin (41) implanted in a flange (39) of said punch guide (33) and adjustably engaged with any selected one of a plurality of location holes (43) formed in a lower end and along a circumference of said cylinder end (17), the assembly length of the punch assembly being adjusted by axial thread engagement movement between both said punch body (19) and said punch body fixing portion (21) of said piston.

In the stripper device for a punching tool according to the present invention, whenever the punch head is struck by a striker of the punch press, since the gas is compressed by the piston pushed into the gas cylinder, a resilient force as shown in FIG. 4 can be generated by the gas cylinder. In this case, since the increase rate (i.e., the gradient or the spring constant (KN/mm)) of the resilient force (or compression force) (KN) of the piston with respect to the piston stroke (mm) (i.e., the thickness of the plate to be punched) is about $1/2.5$ times smaller that of the conventional compression spring, it is possible to reduce the change rate of the plate pushing force according to the change rate of the plate thickness of the punched workpiece. In other words, it is possible to obtain a relatively uniform plate pushing force, even if the plate thickness of the plate material to be punched changes.

Further, in the stripper device for a punching tool according to the present invention, since the gas pressure is adopted as the resilient force generating means, instead of the compression spring, it is possible to prevent the stripping force generating means from a concentrated internal stress.

In the punch assembly according to the present invention, when the punch body is mounted on the stripper device, it is possible to eliminate an axial force applied between the stripper device and the punch body. Further, the assembly length of the punch assembly can be adjusted finely by adjusting the rational position of the stripper device relative to the punch body.

BRIEF DESCRIPTION OF THE DRAWINGS

FIGS. 6A, 6B and 6C are enlarged side views showing the cutting edge portion of the punch body respectively, in which FIG. 6A shows that obtained after the invention punch assembly was used N=223 times; FIG. 6B shows that obtained after the invention punch assembly was used N=6,351 times; and FIG. 6C shows that obtained after the conventional punch assembly was used N=223 times;

FIGS. 7A, 7B and 7C are enlarged side views showing the primary shearing area PS and the secondary shearing area SS on a cut-off surface of plate material respectively, in which FIG. 7A shows that obtained after plate material was punched by the invention punch assembly by N=223 times; FIG. 6B shows that obtained after plate material was punched by the invention punch assembly by N=6,351 times; and FIG. 7C shows that obtained after plate material was punched by the conventional punch assembly by N=223 times;

DETAILED DESCRIPTION OF THE EMBODIMENTS

The embodiments of the stripper device for a punching tool and the punch assembly using the same stripper device according to the present invention will be described hereinbelow with reference to the attached drawings.

Figure 2:
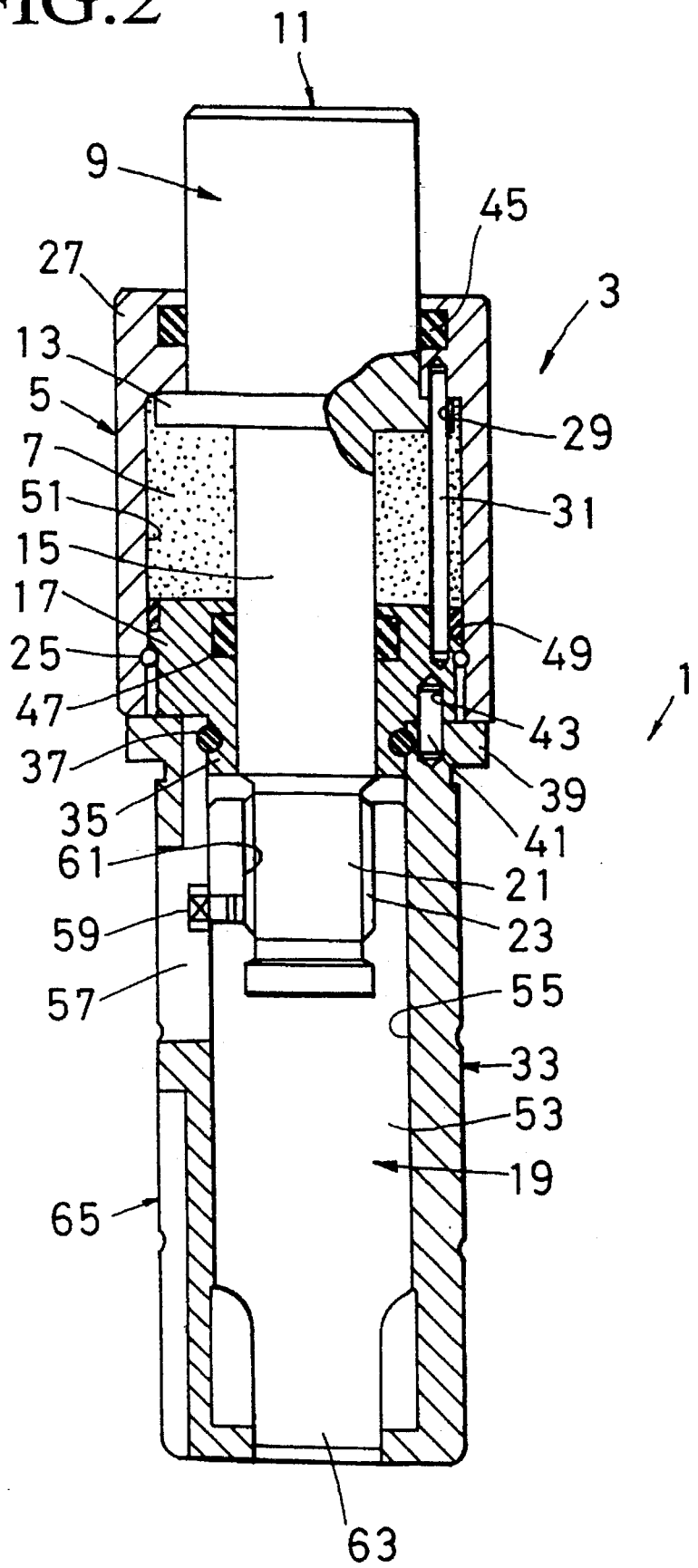
FIG. 2 is a cross-sectional view showing the punch assembly having a first embodiment of the stripper device for a punching tool according to the present invention.

FIG. 2 shows the punch assembly having a first embodiment of the stripper device according to the present invention. In FIG. 2, the punch assembly 1 is roughly composed of a stripper device 3, a punch body 19, and a punch guide 33.

The stripper device 3 will be first described. The stripper device 3 is roughly composed of a gas cylinder 5 and a piston 9. The gas cylinder 5 is formed with a cylinder head 27, and further enclosed by a cylinder end 17 at a lower portion of the cylinder head 27 airtightly. The cylinder end 17 is fixed to the gas cylinder 5 with the use of a snap spring 25. The piston 9 is formed with a punch head 11, an engagement flange 13, a piston rod 15, and a punch body fixing portion 21. Further, a gas 7 is enclosed within the gas cylinder 5. The punch head 11 of the piston 9 partially projects from an upper side of the gas cylinder 5 under airtight conditions. The engagement flange 13 of the piston 9 is provided to prevent the piston 9 from being removed from the inside of the gas cylinder 5. Further, the punch body fixing portion 21 of the piston 9 completely projects from the cylinder end 17 under airtight conditions. The punch body fixing portion 21 is formed with a male thread 23.

Further, an axial rod 31 is provided so as to pass through an engagement hole 29 formed in the engagement flange 13 of the piston 9 and extend between the cylinder head 27 and the cylinder end 17 of the gas cylinder 5 in parallel to the piston rod 15.

Accordingly, the piston rod 15 of the piston 9 can be moved within the gas cylinder 5 only in the axial direction, but cannot be rotated in the gas cylinder 5 around the axis thereof, because the presence of the axial rod 31. In this case, the engagement hole 29 formed in the engage flange 13 of the piston 9 can be replaced with an engage groove opened so as to be engaged with the axial rod 31.

The cylinder end 17 is formed with a lower engage projection 35 engaged with the punch guide 33 of the punch assembly 1. The cylinder end 17 is further formed with a plurality of locating holes 43 on the lower end surface thereof and along the circumference thereof. On the other hand, a plurality of locating pins 41 are implanted on the upper end surface and along the circumference of a flange portion 39 of the punch guide 33 of the punch assembly 1. These locating pins 41 of the punch guide 33 are fitted into the locating holes 43 formed in the cylinder end 17 for location of the punch guide 33 relative to the stripper device 3.

The cylinder end 17 is sealed from the punch guide 33 by an O-ring (sealing member) 37 disposed on the outer circumferential groove formed in the lower engagement projection 35 of the cylinder end 17. Further, another sealing member 45 is interposed between the cylinder head 27 of the gas cylinder 5 and an outer sliding surface of the punch head 11 of the piston 9 to keep the inside of the gas cylinder 5 under airtight conditions. In the same way, the other sealing members 47 and 49 are interposed between the piston rod 15 of the piston 9 and inner and outer surfaces of the cylinder end 17, respectively.

In the above-mentioned structure, a gas charge chamber 51 is formed between the gas cylinder 5 and the piston rod 15, and further filled with a gas to obtain a resiliency (a stripping force) required for the stripper device 3. The gas is put into the gas charge chamber 51 through an appropriate gas inlet hole (not shown) under an appropriate pressure. In this embodiment, the gas is a high pressure nitrogen gas, for instance, and the stripper device 3 is so designed as to obtain a resiliency (stripping force) of about 3,000 kg at its maximum.

Figure 4:
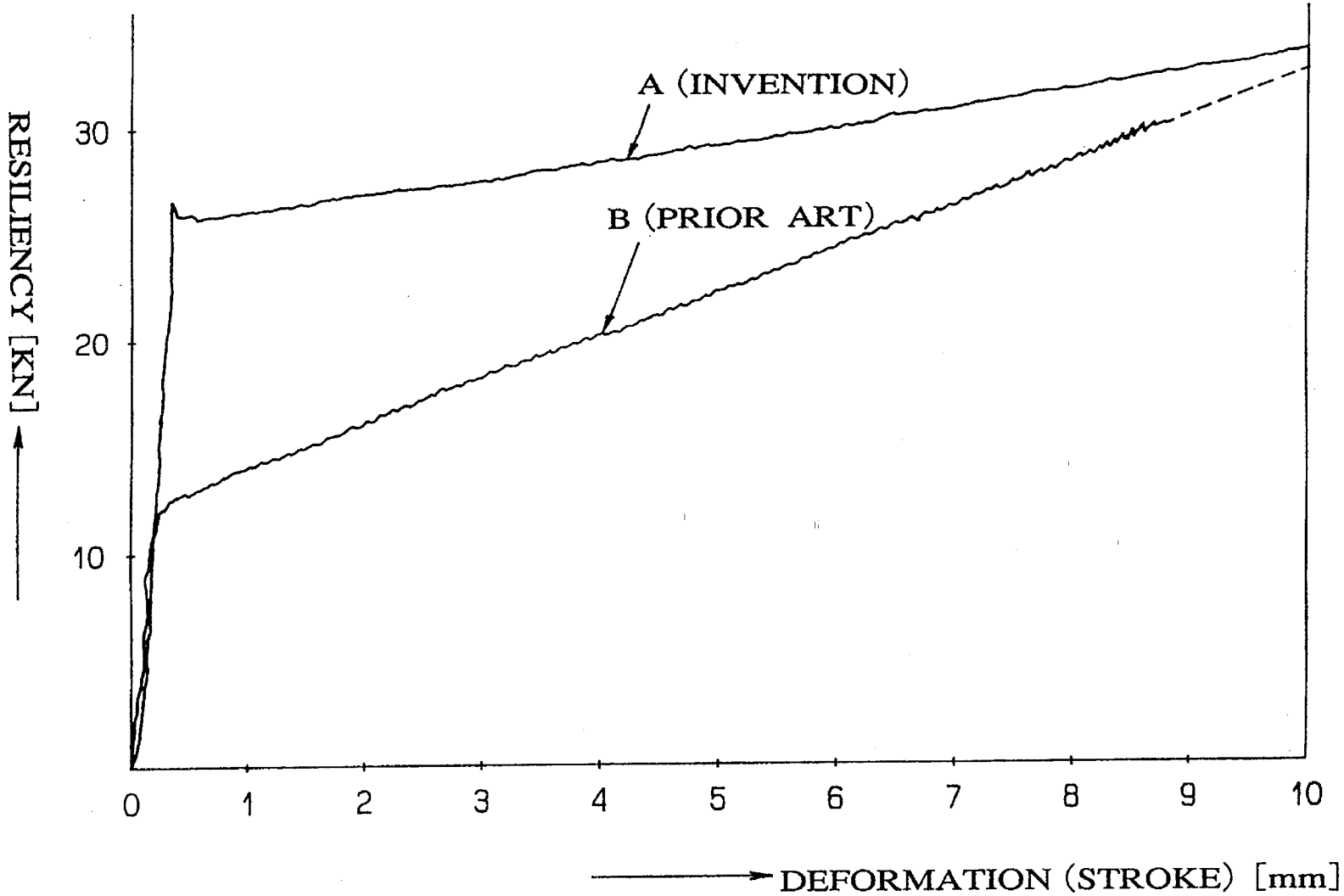
FIG. 4 is a graphical representation showing the relationship between the resiliency (force) (KN) and the deformation (stroke) (mm) of the stripping force generating means, in which A denotes that of the invention stripper device (gas) and B denotes that of the conventional stripper device (compression spring)

FIG. 4 shows the relationship between the resiliency (stripping force) (KN) applied to the piston 9 and the deformation (piston stroke) (mm), in which curve A represents that of the stripper device of the invention punch assembly 1 and curve B represents that of the compression spring of the conventional punch assembly 101.

FIG. 4 indicates that in the stripper device of the punch assembly according to the present invention, the increase rate of the stripping force (resiliency) with respect to the piston stroke (deformation), that is, the spring constant is about ½.5 times smaller than that of the compression spring of the conventional punch assembly. Here, it should be noted that in the present invention, it is possible to freely change the spring constant by changing the volume of the gas cylinder 5, without changing the stroke and the maximum stripping force of the stripper device.

On the other hand, the punch guide 33 is formed into a hollow cylindrical shape. The punch guide 33 is formed with a guide hole 55 for guiding a trunk portion 53 of the punch body 19 in the axial direction thereof and with a flange portion 39 at the upper end thereof. A key groove 57 is formed in the side wall of the punch guide 33 so as to extend from the upper end surface thereof to roughly the middle portion of the punch guide 33 in the axial direction. A key 59 engaged with the key groove 57 is attached to the outer circumferential surface of the trunk portion 53 of the punch body 19 fitted to the guide hole 55 of the punch guide 33. Therefore, the punch body 19 can be moved within the punch guide 33 in the axial direction thereof, but cannot be rotated therewithin.

The punch body 19 is formed with a female thread 61 at the upper end thereof and a cutting edge portion 63 at the lower end thereof. The female thread 61 is mated with the male thread 23 formed at the punch body fixing portion 21 of the piston 9 when the punch body 19 is fixed to the piston rod 15 of the piston 9. Further, it is of course possible to form the female thread 61 in the piston rod 15 and the male thread 23 in the punch body 19 reversely.

Here, the lowermost end surface of the cutting edge portion 63 is so adjusted as to be located about 2 mm inward away from the lowermost end surface of the punch guide 33 when the piston 9 of the stripper device 3 is positioned at the-uppermost position, as shown in FIG. 2.

Further, the punch guide 33 is formed with an outer key groove 65 engageable with a key (not shown) formed in a die holder of a punch press to decide the angular position of the punch guide 33 relative to the die (not shown), for instance when the punch assembly 1 (of a male type) is used with the punch press.

As understood above, in the punch assembly 1 according to the present invention, when the locating pins 41 implanted on the flange 39 of the punch guide 33 are fitted to the locating holes 43 formed in the cylinder end 17 of the stripper device 3, the punch body 19 fixed to the piston 9 through the threads 23 and 61 can be moved relative to the punch guide 33 in the axial direction thereof, but cannot be rotated in the punch guide 33.

In the punch assembly 1 of the present invention, the axial length (assembly length) of the punch assembly 1 can be finely adjusted by rotating the piston 9 relative to the punch body 19; that is, by adjustably screwing the male thread portion 23 of the punch body fixing portion 21 of the piston 9 into the female thread portion 61 of the punch trunk portion 53 of the punch body 19. In more detail, first the stripper device 3 and the punch body 19 are moved upward away from the punch guide 33 to release the locating pins 41 from the locating holes 43, and then the piston 9 is rotated relative to the punch body 19 to determine an appropriate assembly length through the mated threads 23 and 61, before fitting the locating pins 41 into the locating holes 43. In other words, the axial length of the punch assembly 1 can be finely adjusted by determining the angular position of the piston 9 relative to the punch body 19.

Figure 3A:
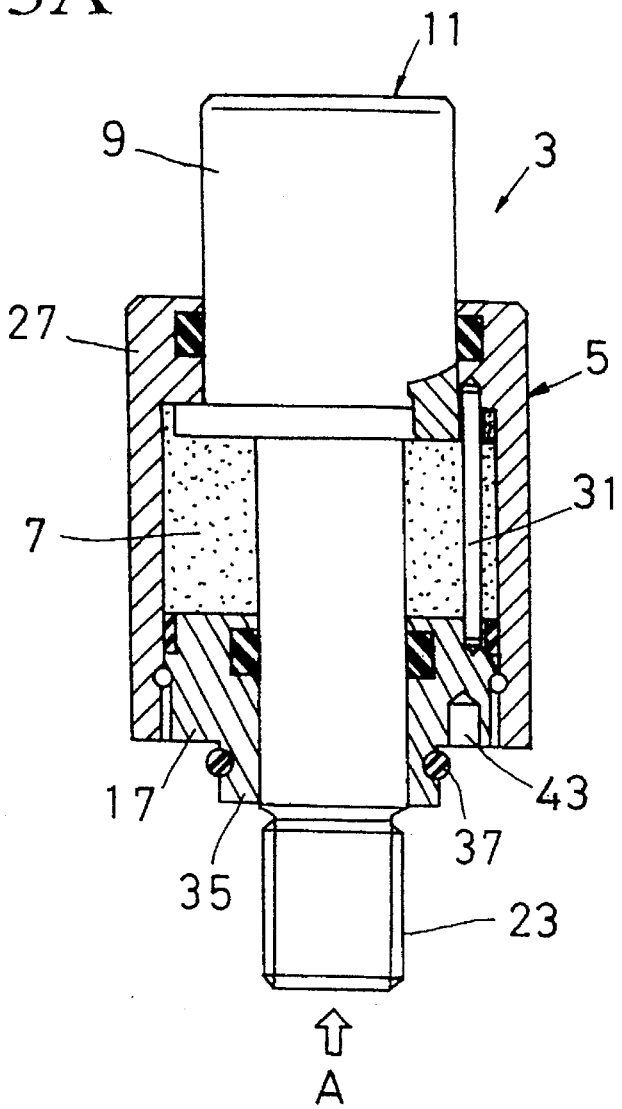
FIG. 3A is a cross-sectional view showing only the stripper device 3 shown in FIG. 2, in which the punch body is removed.
Figure 3B:
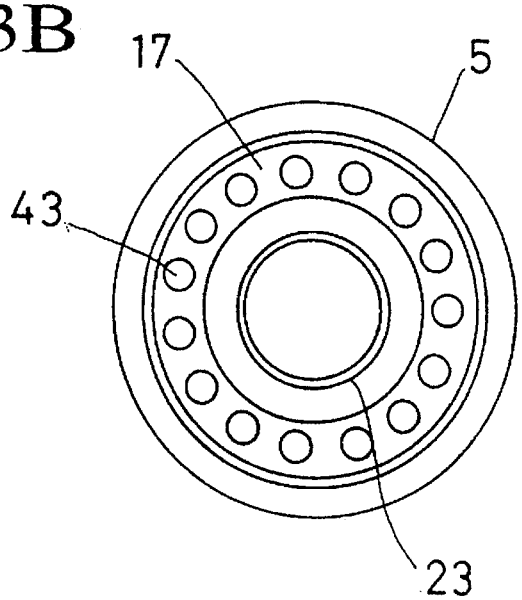
FIG. 3B is a bottom view showing the cylinder end shown in FIG. 3A, when seen along arrow A in FIG. 3A.

FIG. 3A shows only the stripper device 3 shown in FIG. 2, and FIG. 3B shows a bottom view of the stripper device 3 shown in FIG. 3A, when seen from an arrow A in FIG. 3A. In FIG. 3B, 15 pieces of the locating holes 43 are arranged along the circumference of the cylinder end 17. Therefore, if the threads 23 and 61 of M16 (pitch=2.0 mm) are used for the punch body fixing portion 21 of the piston rod 15 and the punch body 19, it is possible to finely adjust the assembly length or height in units of as fine as about 0.1 mm.

Figure 1:
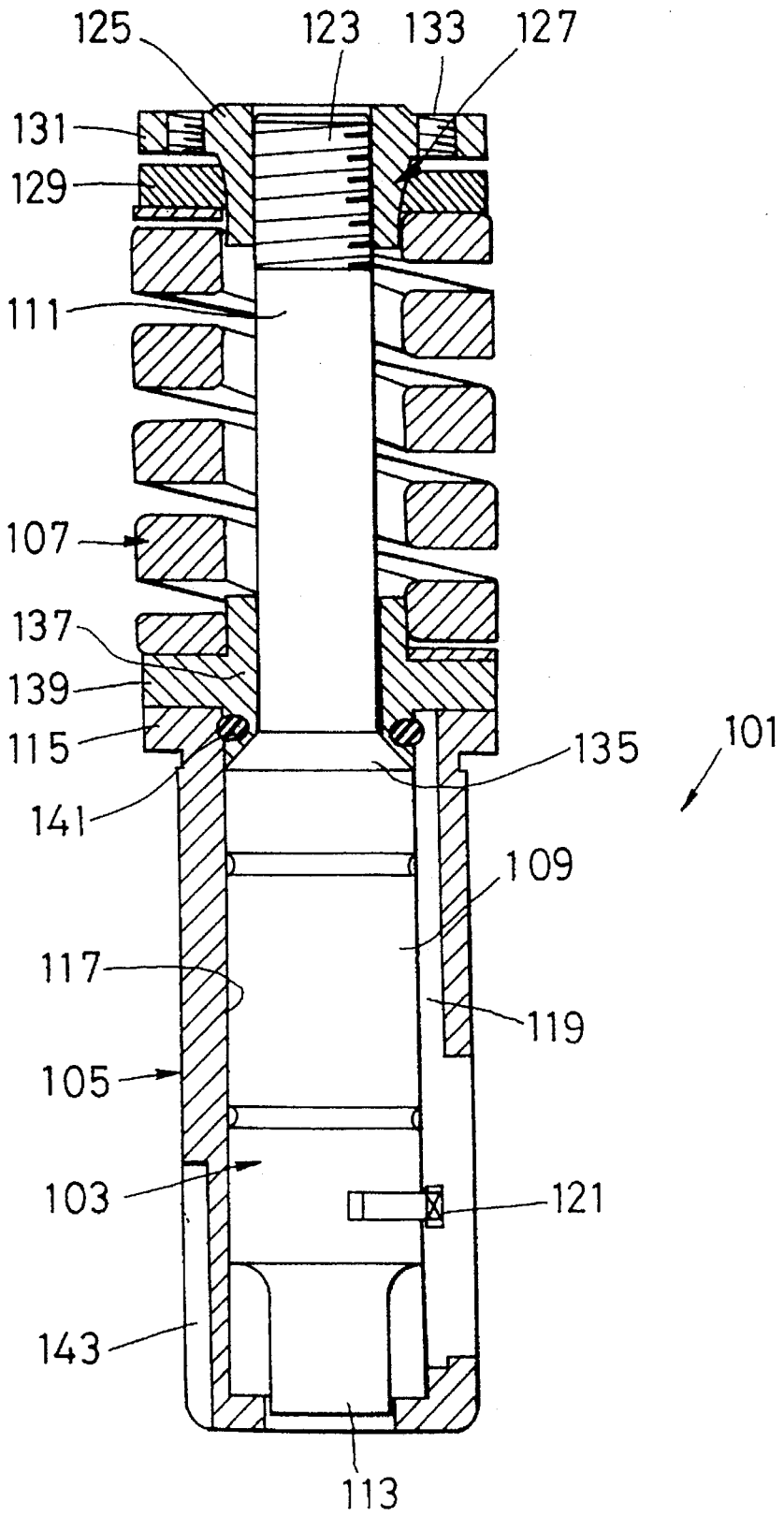
FIG. 1 PRIOR ART
FIG. 1 is a cross-sectional view showing a conventional punch assembly including a compression spring.

The empirical results of the punch assembly 1 having the first embodiment of the stripper device 3 according to the present invention shown in FIG. 2 will be described hereinbelow with reference to the attached drawings, in comparison with those of the prior art punch assembly 101 having the compression spring 107 shown in FIG. 1.

Figure 5:
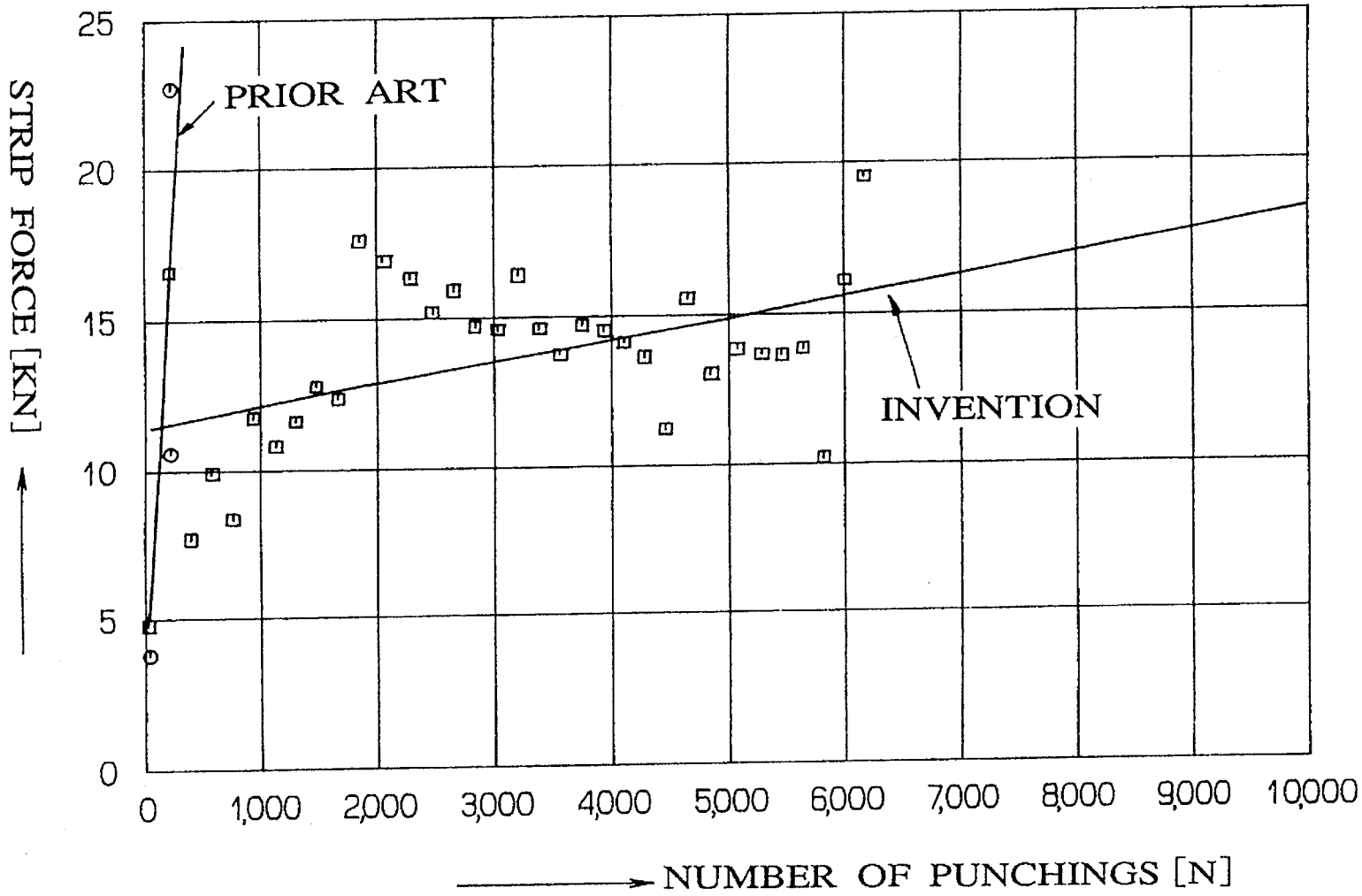
FIG. 5 is a graphical representation showing the relationship between the resiliency (stripping force) (KN) and the number of punchings, in which circular dots represent that of the invention stripper device (gas) and square dots represent that of the conventional stripper device (compression spring)

The empirical conditions are as follows:

(a) Punching speed: 25 mm/sec (b) Plate material used: SPHC. 6t (c) Punch size and shape: 30×30 mm square (d) Die clearance: 0.9 mm FIG. 5 shows the change rate of the stripping force with respect to the number of the punchings, in which the abscissa indicates the number of punchings [N] and the ordinates indicates the stripping force [KN].

Further, the maximum number of punchings is defined as the number of punchings at which the stripping miss first occurs during continuous punchings. In this case, the maximum number of punchings was 223 in the case of the prior art punch assembly 101, but 6,351 in the case of the punch assembly 1 of the present invention. Further, FIG. 5 indicates that the stripping force increases sharply in the case of the prior art punch assembly 101, in comparison with that of the invention punch assembly 1. The stripping force mainly increases when the cutting edge portion of the punch body adheres to the punched material due to fusion. Therefore, FIG. 5 indicates that the fusion progresses slowly in the punch assembly 1 according to the present invention, as compared with the prior art punch assembly 101. The reason of the slow fusion phenomenon of the invention punch assembly will be explained in further detail with reference to FIGS. 6A, 6B and 6C, each of which is an enlarged side view showing the fusion phenomenon at the cutting edge portion 63 (shown on the lowermost side) of the invention punch assembly 1 (in FIGS. 6A and 6B) and the cutting edge portion 113 of the prior art punch assembly 101, all obtained after the experiment.

Figure 6A:
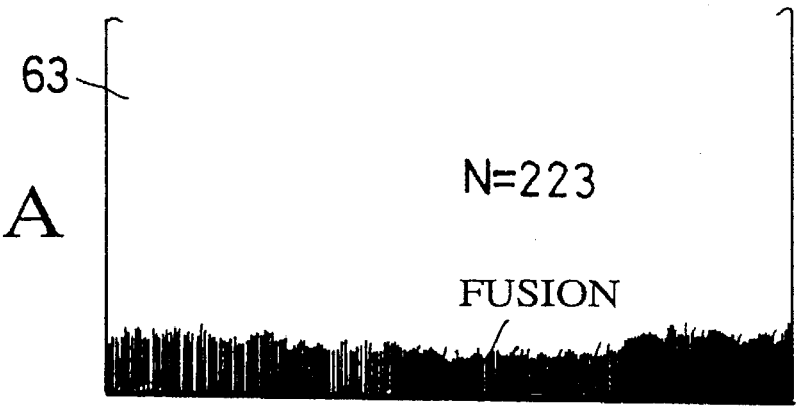
Figure 6B:
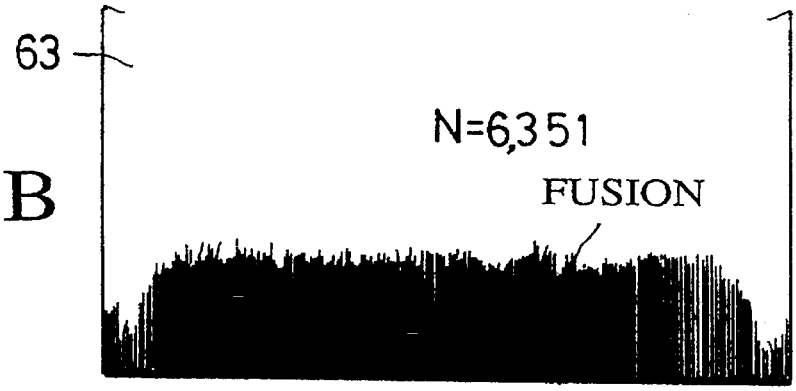
Figure 6C:
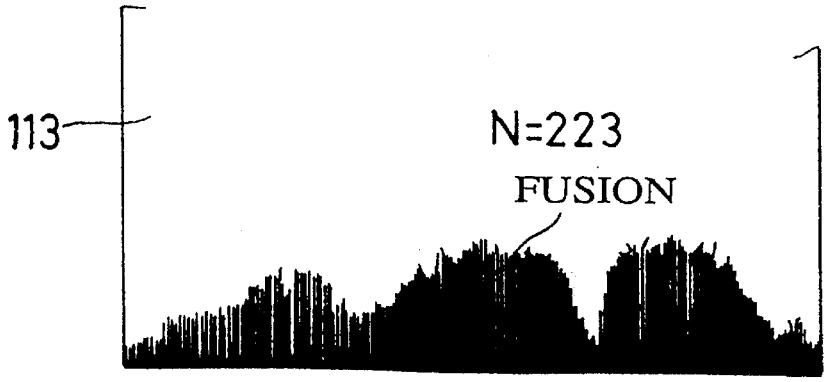
FIG.6C PRIOR ART

FIG. 6A shows the fusion phenomenon of the invention punch assembly 1 obtained when the number of punching reaches N=223; FIG. 6B shows the fusion phenomenon of the invention punch assembly 1 obtained when the number of punching reaches N=6, 351 (the maximum punching number); and FIG. 6C shows a fusion phenomenon of the conventional punch assembly 101 obtained when the number of punching reaches N=223 (the maximum punching number). In comparison between FIGS. 6A and 6C, it is apparent that the fusion phenomenon of the invention punch assembly 101 shown in FIG. 6A is less than that of the conventional punch assembly 101 shown in FIG. 6C, with the result that the stripping force of the invention punch assembly 101 is small and therefore the maximum number of punchings is large, as compared with the conventional punch assembly 101.

Figure 7A:
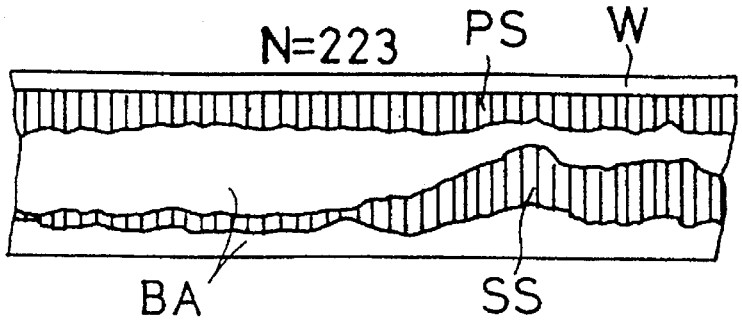
Figure 7B:
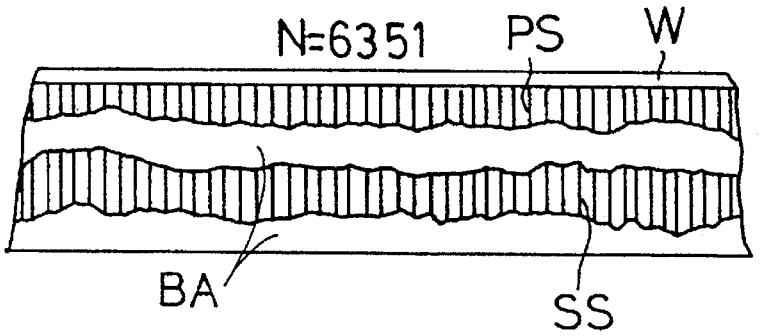
Figure 7C:
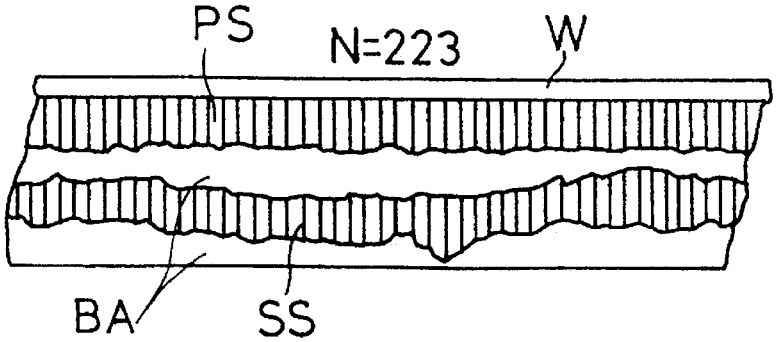
FIG.7C PRIOR ART

FIGS. 7A, 7B and 7C are enlarged side views showing the punched-off surfaces of material (workpiece) W punched by the punch assembly, in which PS denotes the primary shearing area, SS denotes the secondary shearing area, and the white portion denotes a broken area BA and in which the punch side is shown on the upper side and the die side is shown on the lower side. FIG. 7A shows the punched-off surface obtained by the invention punch assembly 1 when the number of punching reaches N=223; FIG. 7B shows the punched-off surface obtained by the invention punch assembly 1 when the number of punching reaches N=6, 351 (the maximum punching number); and FIG. 7C shows the punched-off surface obtained by the conventional punch assembly 101 when the number of punching reaches N=223 (the maximum punching number). In general, when the punching speed is low, the primary and secondary shearing areas PS and SS increases and the fusion phenomenon also occurs easily. In comparison between FIGS. 7A and 7C, it is apparent that the secondary shearing area SS obtained by the invention punch assembly 101 shown in FIG. 7A is less than that obtained by the prior art punch assembly 101 shown in FIG. 7C, with the result that the stripping force of the invention punch assembly 101 is small and therefore the maximum number of punchings is large, as compared with the prior art punch assembly 101. Further, in comparison between FIGS. 7B and 7C, the secondary shearing area SS shown in FIG. 7B (N=6,351) obtained by the invention punch assembly 1 is roughly the same as that SS shown in FIG. 7C (N=223) obtained by the prior art punch assembly 101.

Figure 8A:
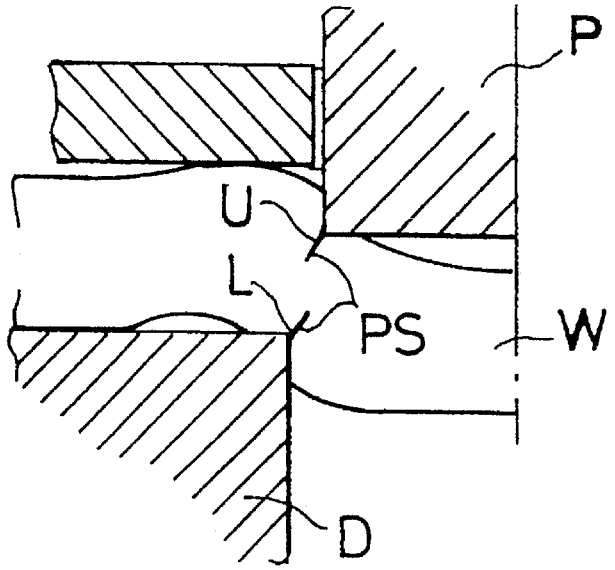
FIGS. 8A and 8B are cross-sectional views showing a plate material now being sheared, for assistance in explaining the primary shearing area and the secondary shearing area.
Figure 8B:
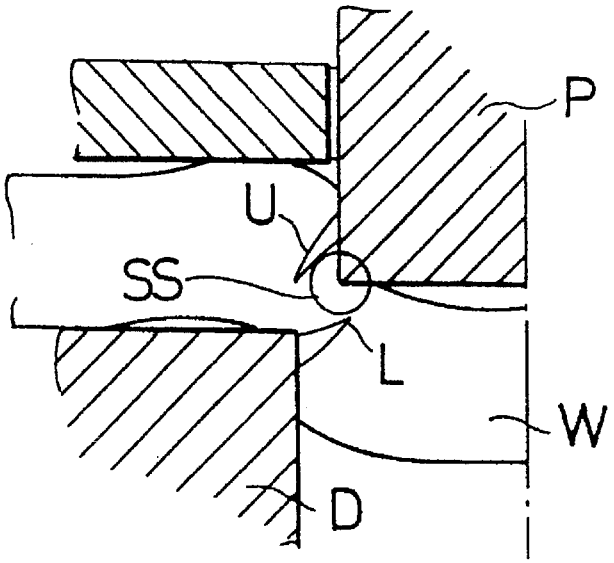

Further, FIGS. 8A and 8B are cross-sectional views showing the work W now being punched, for assistance in explaining the process of generating the secondary shearing SS, in which P denotes the punch and D denotes the die. At the punching speed of 25 mm/sec (in this experiment), when the fusion phenomenon does not occur (before the maximum number of punching) as shown in FIG. 7A, since the upper and lower cut-off sides U and L of the work W to be punched are smoothly connected, the primary shearing area PS can be mainly obtained. On the other hand, when the fusion phenomenon occurs (at and after the maximum number of punching) as shown in FIG. 7B, since the upper and lower cut-off sides U and L of the work W to be punched are disconnected, the secondary shearing area SS is also obtained.

Figure 9:
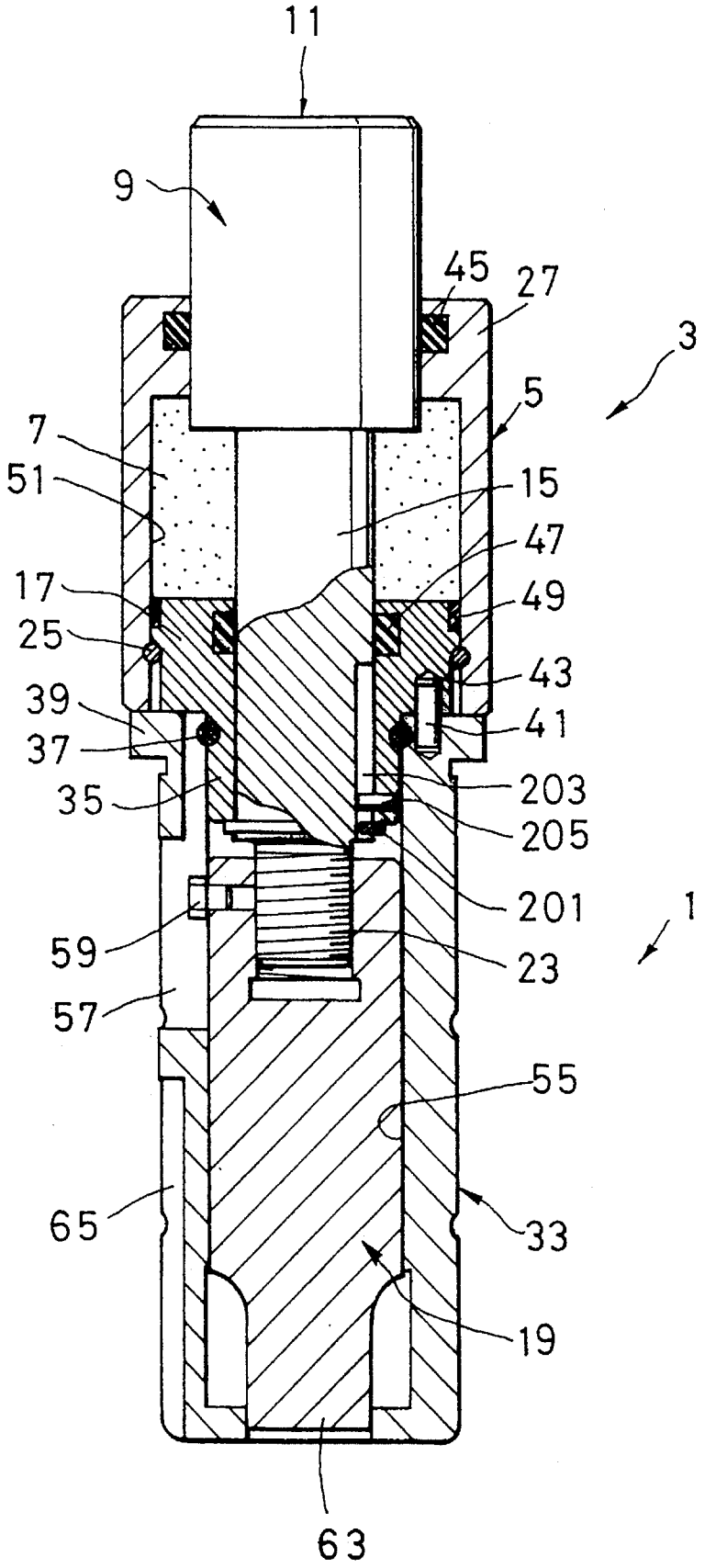
FIG. 9 is a cross-sectional view showing the punch assembly having a second embodiment of the stripper device for a punching tool according to the present invention.

FIG. 9 shows as a second embodiment of the stripper device 3 of the punch assembly 1 according to the present invention. This second embodiment is substantially the same as the first embodiment in the structure and the function, except that the engage flange 13 of the piston rod 15 (of the first embodiment) is replaced with a snap ring 201 and the rotational movement restricting means 203,205. Accordingly, the same reference numerals have been retained for similar parts or elements which have the same functions as with the case of the first embodiment previously described, without repeating any detailed description.

In FIG. 9, the snap ring 201 is attached to the lower end of the piston rod 15 of the piston 9, instead of the engage flange 13 attached to the upper end of the piston rod 15 shown in FIG. 2, in order to prevent the piston 9 from being removed from the gas cylinder 5. In addition, instead of the use of the axial rod 31 shown in FIG. 2, a key groove 203 is formed in the piston rod 15 and a key 205 engaged with the key groove 203 is attached to the inner surface of the lower engage projection 35 of the cylinder end 17. Further, the axial length of the key groove 203 is determined to be slightly longer than the stroke of the piston rod 15. In this second embodiment, it is possible to obtain the same effect as the rotational movement restricting means such that the piston 9 can be moved in the axial direction without rotation relative to the gas cylinder 5.

As described above, in the stripper device of the punch assembly according to the present invention, even if the thickness of the plate material changes, that is, even if the piston stroke (deformation) of the piston changes, it is possible to obtain a relatively uniform stripping force in a wide range from a thick plate material to a thin plate material. As a result, it is possible to prevent any stripping miss caused by lack of the stripping force required when a relatively thin plate material is punched out.

Further, in the conventional stripper device using a compression spring or a dish spring, since a high stress is generated and further concentrated locally in the spring according to an increase of deformation, the lifetime of the spring is short. In the invention stripper device, however, since the stripping force can be generated by a gas cylinder, the durability of the stripping force generating means can be improved.

Further, in the punch assembly according to the present invention, whenever the cutting edge portion of the punch is required to be polished, since the assembly length of the punch assembly can be adjusted finely by use of the locating pins and the locating holes, the readjustment work of the punch assembly length can be simplified without need of any large force.

Further, in the punch assembly according to the present invention, since the fusion of the material onto the cutting edge portion of the punch body can be reduced, it is possible to reduce the number of polishings of cutting edge portion and further to improve the lifetime of the punching tool.

What is claimed is:

1. A stripper device for a punching tool, comprising:

a gas cylinder filled with a gas having:

a cylinder head; and a cylinder end attached in airtight fashion to a lower portion of said cylinder head;

a piston having:

a punch head; and a piston rod;

an engagement flange formed between said piston rod and said punch head and located in an inner space of said gas cylinder for restricting an axial movement of said piston in said gas cylinder filled with the gas, said engagement flange having an engagement hole formed therein; and an axial rod provided between said cylinder head and said cylinder end loosely passed through said engagement hole for restricting a rotational movement of said piston in said gas cylinder;

a stripper device, wherein a stripping force of the stripper device is obtained by a resilient force generated whenever the gas is compressed by said piston within said gas cylinder for each punching operation.

2. The stripper device for a punching tool of claim 1, further comprising a snap ring attached to a lower end of said piston rod and located in an outer side of said gas cylinder for restricting an axial movement of said piston in said gas cylinder filled with the gas.

3. The stripper device for a punching tool of claim 2, wherein a key groove is formed in an inner surface of said cylinder end and a key is attached to an outer surface of said punch head along an axial direction thereof, for restricting a rotational movement of said piston in said gas cylinder.

4. The stripper device for a punching tool of claim 1, wherein said cylinder end further comprises a lower engagement projection engaged with a guide hole of a punch guide attached to the cylinder end.

5. The stripper device for a punching tool of claim 1, wherein said piston further comprises a punch body fixing portion for fixing a punch body to a lower end of said piston.

6. A punch assembly, comprising:

a gas cylinder filled with a gas having:

a cylinder head; and a cylinder end attached in airtight fashion to a lower portion of said cylinder head;

a piston having:

a punch head;

a piston rod; and a punch body fixing portion formed with a thread portion;

an engagement flange formed between said piston rod and said punch head and located in an inner space of said gas cylinder for restricting an axial movement of said piston in said gas cylinder filled with the gas, said engagement flange having an engagement hole formed therein; and an axial rod provided between said cylinder head and said cylinder end loosely passed through said engagement hole for restricting a rotational movement of said piston in said gas cylinder, a stripper device, a stripping force of the stripper device being obtained by a resilient force generated whenever the gas is compressed by said piston within said gas cylinder for each punching operation;

a punch guide formed with a hollow guide hole and attached to a lower end of said cylinder end;

a punch body fitted to the hollow guide hole of said punch guide and formed with a cutting edge at a lower end thereof and another thread portion engaged with a lower male thread portion formed on said punch body fixing portion;

a rotational movement restricting means for restricting a rotational movement of said punch body in said punch guide;

said punch body and said punch guide forming a punch assembly; and means for finely adjusting an assembly length of the punch assembly whenever the punch assembly is disassembled for polishing the cutting edge of said punch body.

7. The punch assembly of claim 6, further comprising a snap ring attached to a lower end of said piston rod and located in an outer side of said gas cylinder for restricting an axial movement of said piston in said gas cylinder filed with the gas.

8. The punch assembly of claim 7, wherein a key groove is formed in an inner surface of said cylinder end and a key is attached to an outer surface of said punch head along an axial direction thereof, for restricting a rotational movement of said piston in said gas cylinder.

9. The punch assembly of claim 6, wherein said cylindrical end further comprises a lower engagement projection engaged with a guide hole of a punch guide attached to the cylinder end.

10. The punch assembly of claim 6, wherein said rotational movement restricting means is a key attached to said punch body and engaged with a key groove formed in said punch guide.

11. The punch assembly of claim 6, wherein said assembly length adjusting means comprises: at least one locating pin implanted in a flange of said punch guide and adjustably engaged with any selected one of a plurality of location holes formed in a lower end and along a circumference of said cylinder end, the assembly length of the punch assembly being adjusted by an axial thread engagement movement between both said punch body and said punch body fixing portion of said piston.

* * * * *